US008511405B2

(12) United States Patent
Frazier

(10) Patent No.: US 8,511,405 B2
(45) Date of Patent: Aug. 20, 2013

(54) DRILL BIT WITH TIERED CUTTERS

(76) Inventor: Ryan Clint Frazier, Weatherford, TX (US)

( * ) Notice: Subject to any disclaimer, the term of this patent is extended or adjusted under 35 U.S.C. 154(b) by 339 days.

(21) Appl. No.: 12/771,881

(22) Filed: Apr. 30, 2010

(65) Prior Publication Data

US 2011/0266072 A1 Nov. 3, 2011

(51) Int. Cl.
*E21B 10/573* (2006.01)

(52) U.S. Cl.
USPC ..... 175/430; 175/428; 175/432

(58) Field of Classification Search
USPC ..... 175/432, 433, 428, 430
See application file for complete search history.

(56) References Cited

U.S. PATENT DOCUMENTS

| | | | | | |
|---|---|---|---|---|---|
| 122,514 | A | | 1/1872 | Bullock | |
| 4,539,018 | A | * | 9/1985 | Whanger et al. | 51/295 |
| 4,911,254 | A | * | 3/1990 | Keith | 175/430 |
| 5,667,028 | A | * | 9/1997 | Truax et al. | 175/428 |
| 5,720,357 | A | * | 2/1998 | Fuller et al. | 175/428 |
| 5,979,578 | A | * | 11/1999 | Packer | 175/432 |
| 6,272,753 | B2 | * | 8/2001 | Packer | 76/108.2 |
| 6,315,066 | B1 | * | 11/2001 | Dennis | 175/431 |
| 6,443,249 | B2 | * | 9/2002 | Beuershausen et al. | 175/431 |
| 6,655,234 | B2 | | 12/2003 | Scott | |
| 6,986,297 | B2 | | 1/2006 | Scott | |
| 7,267,187 | B2 | | 9/2007 | Kembaiyan | |
| 7,703,559 | B2 | * | 4/2010 | Shen et al. | 175/432 |
| 7,909,121 | B2 | * | 3/2011 | Voronin et al. | 175/435 |
| 2007/0278017 | A1 | * | 12/2007 | Shen et al. | 175/426 |
| 2008/0121433 | A1 | * | 5/2008 | Ledgerwood | 175/327 |
| 2009/0260877 | A1 | | 10/2009 | Wirth | |

* cited by examiner

*Primary Examiner* — William P Neuder
*Assistant Examiner* — Richard Alker
(74) *Attorney, Agent, or Firm* — Scheef & Stone, L.L.P.

(57) ABSTRACT

The present invention relates to a drill bit having a bit body and a plurality of cutters, which are configured to disintegrate earthen formation as the bit body is rotated by a connected drill string. At least some of the cutters have a first and second body, first and second cutting faces and first and second cutting edges. The body is comprised of hard metal. The cutting elements are comprised of superhard material. The orientation of the first cutter body is reversible as to the other components to permit variation in the proximity of the first and second cutting elements.

20 Claims, 4 Drawing Sheets

DRILL BIT WITH TIERED CUTTERS

TECHNICAL FIELD OF THE INVENTION

The present invention relates to a drill bit for drilling bore holes in earthen formations. More particularly, the present invention relates to a drill bit having a plurality of cutters that includes multiple cutting areas.

BACKGROUND OF THE INVENTION

In the exploration of oil, gas, and geothermal energy, drilling operations are used to create boreholes, or wells, in the earth. Drill bits are in the center of such operations, disintegrating earthen formation. A drill bit substantially has a bit body connected by a drill string in one end and a plurality of cutters/cutting elements on the other end of the bit body. Conventionally, these cutters have one cutting area that is made of superhard material, such as polycrystalline diamond. While these cutters have been effective in disintegrating earthen formation, there always has been a need for more effective cutters that can expedite the drilling operations.

SUMMARY OF THE INVENTION

It is a general object of the present invention to provide improved earth boring cutters or cutting elements for a drill bit and improved drill bits.

An earth-boring bit is disclosed. The drill bit has a bit body configured for connection to a drill string. A plurality of cutters is secured to the bit body. The cutters are configured to disintegrate earthen formation as the bit body is rotated by the drill string.

At least one of the cutters comprises a substantially cylindrical first body made of hard metal. A substantially cylindrical first cutting element is attached to an end of the first body. The cutting element is made of a superhard material. A trailing end defines the opposite end of the first body. A first cutting face is located on the first cutting element. A first cutting edge defines a beveled perimeter of the first cutting face. A cylindrical slot is formed in the first body. A substantially cylindrical second body made of hard metal is located in the slot. A substantially cylindrical second cutting element is attached to an end of the second body. The second cutting element is made of a superhard material. A second cutting face is located on the second cutting element. A second cutting edge defines a beveled perimeter of the second cutting face.

In accordance with another exemplary embodiment, the hard metal comprises tungsten carbide. In accordance with another exemplary embodiment, the superhard material comprises polycrystalline diamond. In accordance with another exemplary embodiment, the cutting faces are flat.

One of the principal advantages of the exemplary embodiments is that it provides an additional cutting edge and face to a conventional cutter, which only has one cutting edge and face. Another advantage of the exemplary embodiments is that its additional cutting edge and face can have different orientation from the first cutting edge and face, allowing the bit to disintegrate an area of earthen formation where the first cutting edge and face cannot reach. Naturally, it will improve the effectiveness of a drilling operation, saving significant amounts of time and cost for the operation.

As referred to hereinabove and throughout, the "present invention" refers to one or more exemplary embodiments of the present invention, which may or may not be claimed, and such references are not intended to limit the language of the claims, or to be used to construe the claims in a limiting manner.

BRIEF DESCRIPTION OF THE DRAWINGS

The objects and features of the invention will become more readily understood from the following detailed description and appended claims when read in conjunction with the accompanying drawings in which like numerals represent like elements.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein. As used herein, "substantially" is to be construed as a term of approximation.

As referenced herein throughout, the term "hard metal" refers to metal that is hard enough to withstand pressures and force necessitated in disintegrating earthen formation during drilling operation. Examples of such hard metal include cemented tungsten carbide and the like. The term "superhard material" refers to material that possesses hardness similar to diamonds and greater than that of hard metal. Examples of such superhard material include polycrystalline diamond, cubic boron nitride, thin-film diamond, and the like.

Figure 1:
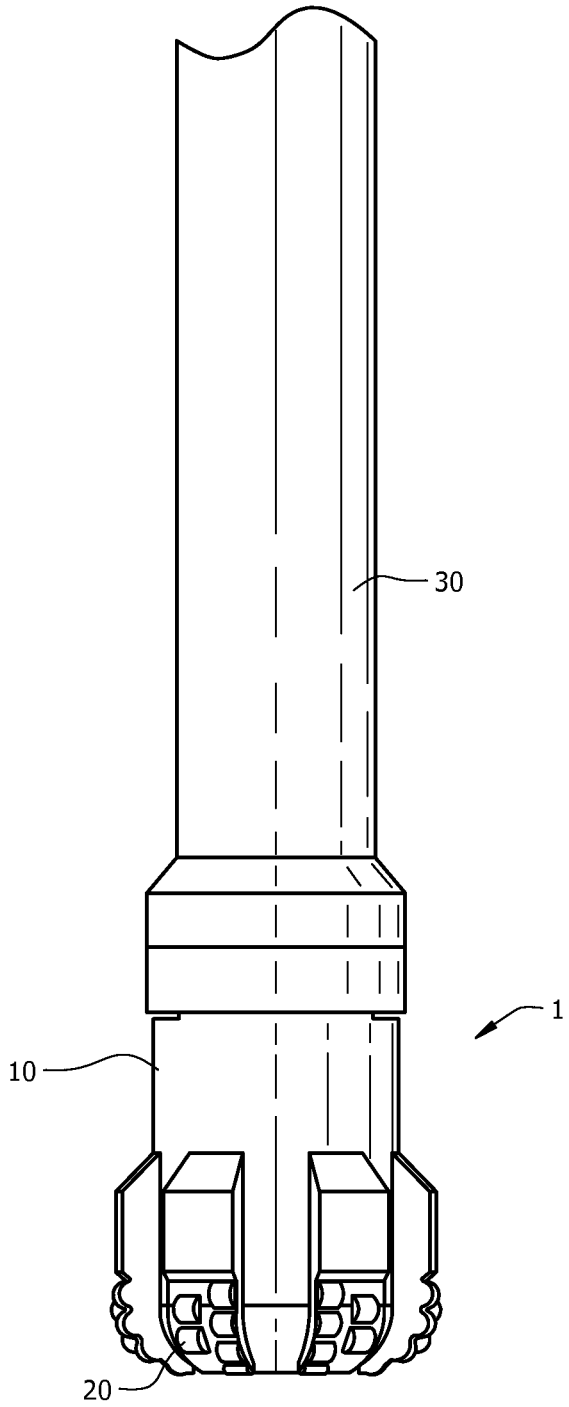
FIG. 1 (Prior Art)
FIG. 1 is a side view of prior art, a drill bit comprising a plurality of single tiered cutters.

Referring to FIG. 1, a side view of a conventional earth-boring drill bit 1 is shown. Conventional earth-boring drill bit 1 comprises a bit body 10 connected to a drill string 30 on one end and a plurality of cutters 20 secured on the other end. As shown, each of the cutters 20 in the conventional earth-boring drill bit 1 has one cutting edge and face.

Figure 2:
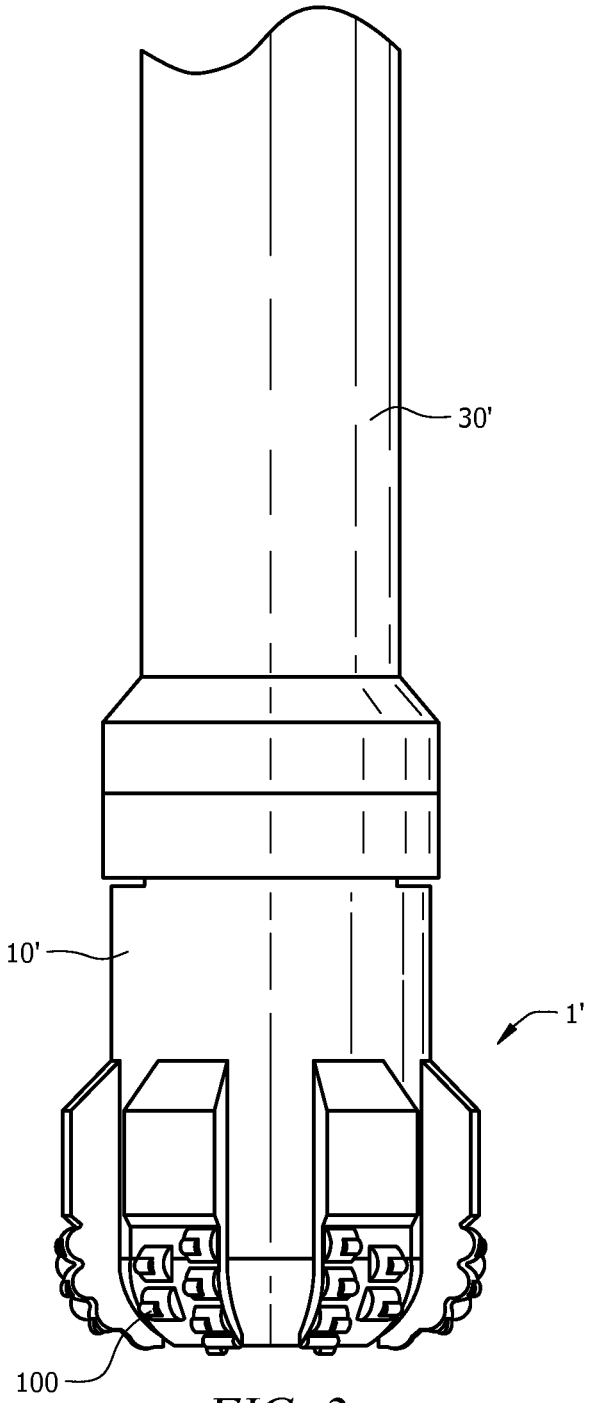
FIG. 2 is a side view of a drill bit in accordance with one of the exemplary embodiments.

Referring to FIG. 2, a side view of an exemplary embodiment of an earth-boring drill bit 1' is shown. Drill bit 1' comprises a bit body 10' connected to a drill string 30' on one end, and a plurality of cutters 100 secured on the opposite end. Bit body 10' is substantially cylindrical in shape. As the drill string 30' rotates, so does the drill bit 1', disintegrating earthen formation with its cutters 100. Drill bit 1' may comprise other exemplary cutters 100, 200, 300, or a combination thereof, as shown in FIGS. 3-6.

Figure 3:
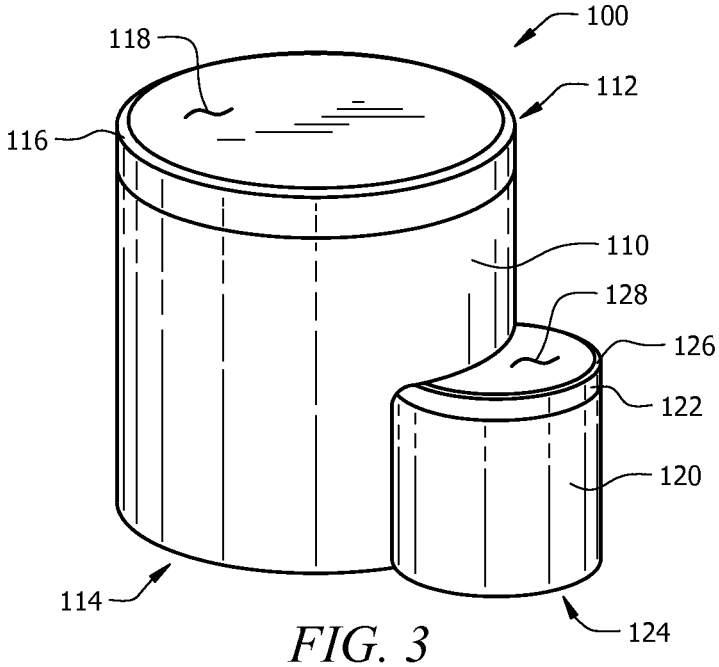
FIG. 3 is an isometric view of a cutter in accordance with one of the exemplary embodiments and shown in FIG. 2.

FIG. 3 is an isometric view of one of the exemplary cutters 100 shown in FIG. 2. Cutter 100 has a first body 110 that includes a first cutting element 112 and a first trailing end 114. First body 110 is substantially cylindrical in shape and may be comprised of hard metals, such as tungsten carbide. First cutting element 112 is substantially cylindrical in shape and includes a first cutting face 118 and a first cutting edge 116. First cutting face 118 is located on top of first cutting element 112 and may be substantially flat. First cutting edge 116 defines the perimeter of first cutting face 118 and may be comprised of superhard materials, such as polycrystalline diamond.

In FIG. 3, between first cutting element 112 and first trailing end 114 of first body 110, there is a second body 120. Second body 120 is substantially cylindrical in shape and has a second cutting element 122 and a second trailing end 124. Second cutting element 122 is substantially cylindrical in shape and has a second cutting face 128 and a second cutting edge 126. Second cutting face 128 is located on top of second cutting element 122 and is substantially flat. Second cutting edge 126 defines the perimeter of second cutting face 128 and may be comprised of superhard materials, such as polycrystalline diamond. Second body 120 may be comprised of hard metals, such as tungsten carbide. Planes of cutting faces 118, 128 may be parallel.

Second body 120 may be located anywhere between first cutting element 112 and first trailing end 114. The axis (not numbered) of second body 120 may be parallel to the axis (not numbered) of first body 110. A slot 140 (not shown) in first body 110 where second body 120 may be inserted may be formed using a cylindrical diamond grinder. Second body 120 may be bonded to slot 140 (not shown) by brazing or chemical adhesive.

In an alternative embodiment, first 110 and second 120 cutter bodies may be integrally formed during the sintering process. The size or diameter of slot 140 may vary by the size or diameter of the second body 120. In the preferred embodiment, the diameter of first body 110 is greater than the diameter of second body 120. In the more preferred embodiment, the diameter of second body 120 is between 80% and 50% of the diameter of first body 110.

In an alternative embodiment, not shown, the orientation of first body 110 can be reversed in relationship to first cutting element 112, such that trailing end 114 is adjacent first cutting element 112. In this embodiment, first body 110 provides additional backing support to the forces acting on second cutting element 122 during drilling. This also permits a variable spacing as between first cutting element 112 and second cutting element 122, by moving second cutting element 122 into closer proximity to first cutting element 112.

Figure 4:
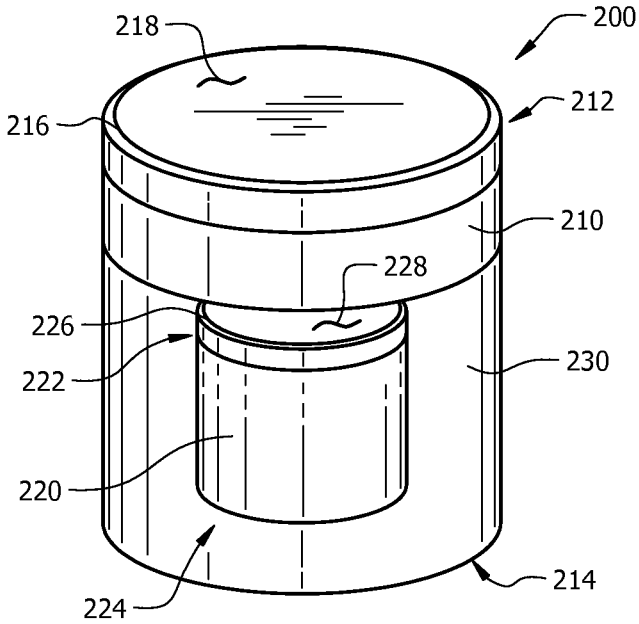
FIG. 4 is an isometric view of a cutter in accordance with another exemplary embodiment.
Figure 5:
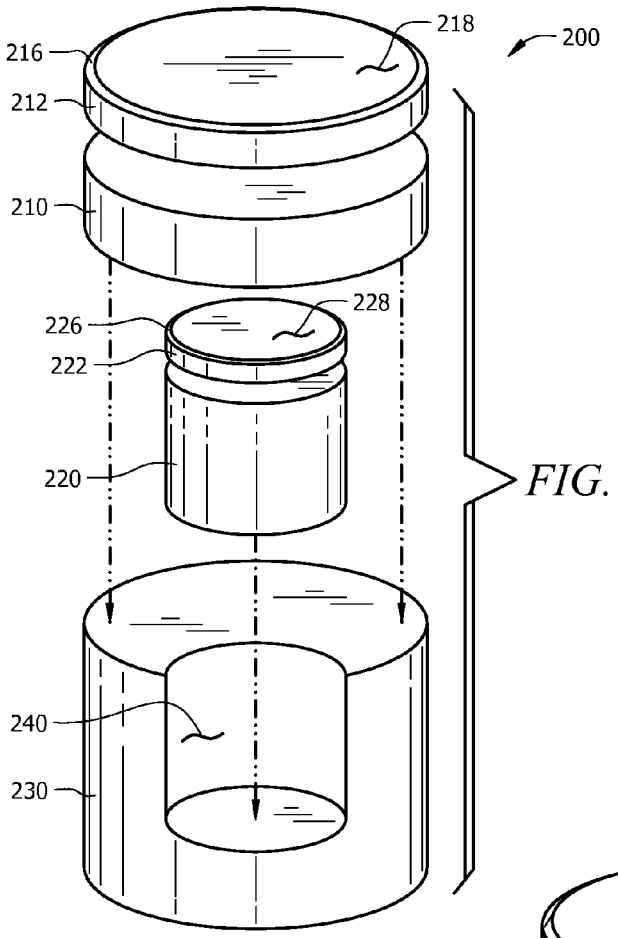
FIG. 5 is an exploded view of the cutter shown in FIG. 4.

Referring to FIGS. 4 and 5, another embodiment of exemplary cutters 200 is illustrated. A substantially cylindrical first body 210 is made of a hard metal, such as tungsten carbide. A substantially cylindrical first cutting element 212 is attached to one end of first body 210 by brazing or other method. First cutting element 212 is made of a superhard material, such as polycrystalline diamond. A trailing end (not shown) defines the opposite end of first body 210.

In a preferred embodiment, first cutting element 212 is substantially cylindrical in shape and includes a first cutting face 218 and a first cutting edge 216. First cutting face 218 is located on top of first cutting element 212 and may be substantially flat. First cutting edge 216 defines the perimeter of first cutting face 218.

A substantially cylindrical second body 230 is made of hard metal, such as tungsten carbide, and is attached in axial alignment to trailing end (not shown) of first body 210. As seen in FIG. 5, a cylindrical slot 240 is formed in second body 230. A substantially cylindrical third body 220 is also made of hard metal, such as tungsten carbide. Third body 220 is located in slot 240. A substantially cylindrical second cutting element 222 is attached to one end of third body 220. Second cutting element 220 is made of a superhard material, such as polycrystalline diamond.

In a preferred embodiment, second cutting element 222 is substantially cylindrical in shape and includes a second cutting face 228 and a second cutting edge 226. Second cutting face 228 is located on top of second cutting element 222 and may be substantially flat. Second cutting edge 226 defines the perimeter of second cutting face 228. In a preferred embodiment, the planes of first 218 and second 228 cutting faces are substantially parallel.

Third body 220 may have the same length as second body 230 but may also be shorter. The axes (not numbered) of first body 210, second body 230 and third body 220 may be parallel to the axis (not numbered) of first body 210. Slot 240 in second body 230, where third body 220 may be inserted, may be formed using a cylindrical diamond grinder. Third body 220 may be bonded to slot 240 by brazing. When inserted, second body 230 provides a carbide backing support to third body 220. The size or diameter of slot 240 may vary by the size or diameter of third body 220. Slot 240 may be partially formed in first body 210. Alternatively, cutter bodies 230 and 220 may be integrally formed during the sintering process.

In an alternative embodiment (not shown), the orientation of second body 230 can be reversed in relationship to first cutting element 212. The location of first body 210 is then relocated to behind second body 230. In this embodiment, first body 210 provides additional backing support to the forces acting on second cutting element 222 during drilling. This also permits a variable spacing as between first cutting element 212 and second cutting element 222 by moving second cutting element 222 into closer proximity to first cutting element 212.

Figure 6:
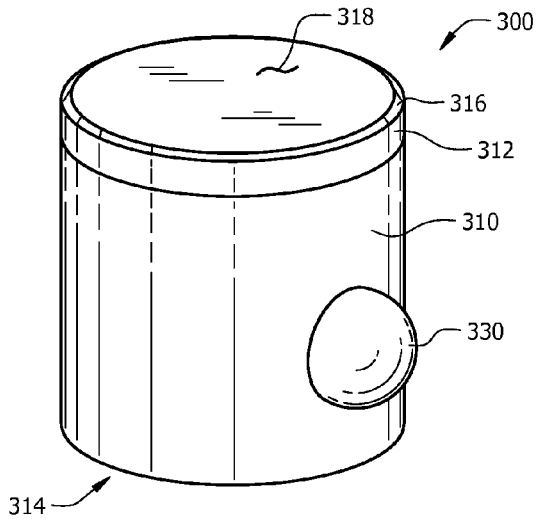
FIG. 6 is an isometric view of a cutter in accordance with another exemplary embodiment.

FIG. 6 is an isometric view of one of the exemplary cutters 300. Exemplary cutter 300 has a body 310 that includes a cutting element 312 and a trailing end 314. Body 310 is generally cylindrical in shape. Between cutting element 312 and trailing end 314, a spherical body 330 extends from body 310. Spherical body 330 and body 310 may be comprised of hard metals, such as tungsten carbide. Spherical body 330 may be bonded by brazing to a slot (not numbered) formed in body 310. The slot may be formed using a diamond grinder. Cutting element 312 is substantially cylindrical in shape and has a cutting face 318 and a cutting edge 316. Cutting face 318 is located on top of cutting element 312 and is substantially flat. Cutting edge 316 defines the perimeter of cutting face 318. Cutting element 312 may be comprised of superhard materials, such as polycrystalline diamond.

It will be readily apparent to those skilled in the art that the general principles defined herein may be applied to other embodiments and applications without departing from the spirit and scope of the present invention.

Having thus described the exemplary embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

The invention claimed is:

1. An earth-boring bit, comprising:

a bit body configured for connection to a drill string; and, a plurality of cutters secured to the bit body, the cutters configured to disintegrate earthen formation as the bit body is rotated by the drill string;

at least one of the cutters comprising:

a substantially cylindrical first body comprising hard metal, and having a center and an outer surface;

a substantially cylindrical first cutting element attached to an end of the first body, the first cutting element comprising a superhard material;

a cylindrical slot formed in the first body, the cylindrical slot having a center that is offset to the center of the cylindrical first body;

the cylindrical slot intersecting the outer surface of the cylindrical first body;

the cylindrical slot nonintersecting with the first cutting element;

a substantially cylindrical second body comprising hard metal located in the slot;

a substantially cylindrical second cutting element attached to an end of the second body, the second cutting element comprising a superhard material;

the first cutting element being substantially parallel to the second cutting element; and, the second cutting element being offset to a position behind the first cutting element.

2. The earth-boring bit of claim 1, further comprising:

a trailing end defining the opposite end of the first body;

a first cutting face located on the first cutting element;

a first cutting edge defining a beveled perimeter of the first cutting face;

a trailing end defining the opposite end of the second body;

a second cutting face located on the second cutting element; and, a second cutting edge defining a beveled perimeter of the second cutting face.

3. The earth-boring bit of claim 1, further comprising:

the first body having a diameter greater than the diameter of the second body.

4. The earth-boring bit of claim 1, further comprising:

the hard metal comprising tungsten carbide.

5. The earth-boring bit of claim 1, further comprising:

the superhard material comprising polycrystalline diamond.

6. The earth-boring bit of claim 1, further comprising:

the first cutting face being substantially parallel to the second cutting face.

7. The earth-boring bit of claim 1, further comprising:

the first cutting face and the second cutting face being substantially flat.

8. The earth-boring bit of claim 1, further comprising:

the second body having a diameter that is between eighty percent and fifty percent of the diameter of the first body; and, the second cutting element having a diameter that is between eighty percent and fifty percent of the diameter of the first cutting element.

9. The earth-boring bit of claim 1, further comprising:

the first cutting element being fully circular; and, the second cutting element being fully circular.

10. The earth-boring bit of claim 1, further comprising:

a portion of the substantially cylindrical second cutting element being unexposed to a formation being drilled.

11. An earth-boring bit, comprising:

a bit body configured for connection to a drill string; and, a plurality of cutters secured to the bit body, the cutters configured to disintegrate earthen formation as the bit body is rotated by the drill string;

at least one of the cutters comprising:

a substantially cylindrical first body comprising hard metal;

a substantially cylindrical first cutting element attached to an end of the first body, the first cutting element comprising a superhard material;

a trailing end defining the opposite end of the first body;

a substantially cylindrical second body comprising hard metal attached to the trailing end of the first body;

a cylindrical slot formed in the second body;

the cylindrical slot nonintersecting with the first cutting element;

a substantially cylindrical third body comprising hard metal located in the slot;

a substantially cylindrical second cutting element attached to an end of the third body, the second cutting element comprising a superhard material;

the first cutting element being substantially parallel to the second cutting element; and, the second cutting element being offset to a position behind the first cutting element.

12. The earth-boring bit of claim 11, further comprising:

the second body being reversible in relation to the first cutting element and the second cutting element; and, the second body being relocatable to a position between the first cutting element and the first body.

13. The earth-boring bit of claim 11, further comprising:

a first cutting face located on the first cutting element;

a first cutting edge defining a beveled perimeter of the first cutting face;

a second cutting face located on the second cutting element; and, a second cutting edge defining a beveled perimeter of the second cutting face.

14. The earth-boring bit of claim 11, further comprising:

the hard material comprising tungsten carbide.

15. The earth-boring bit of claim 11, further comprising:

the superhard material comprising polycrystalline diamond.

16. The earth-boring bit of claim 11, further comprising:

the first cutting face being substantially parallel to the second cutting face.

17. The earth-boring bit of claim 11, further comprising:

the first cutting face and the second cutting face being substantially flat.

18. The earth-boring bit of claim 11, further comprising:

a trailing end defining an end of the second body opposite the first body;

a trailing end defining an end of the third body opposite the second cutting element;

the trailing end of the third body being offset to a position between the trailing end of the first body and the training end of the second body.

19. A cutter for an earth-boring bit, comprising:

a substantially cylindrical first body comprising hard metal, and having a center and an outer surface;

a substantially cylindrical first cutting element attached to an end of the first body, the first cutting element comprising a superhard material;

a cylindrical slot formed in the first body having a center that is offset to the center of the cylindrical first body;

the cylindrical slot intersecting the outer surface of the cylindrical first body;

the cylindrical slot nonintersecting with the first cutting element;

a substantially cylindrical second body comprising hard metal located in the slot;

a substantially cylindrical second cutting element attached to an end of the second body, the second cutting element comprising a superhard material;

the first cutting element being substantially parallel to the second cutting element; and, the second cutting element being offset to a position behind the first cutting element.

20. A cutter for an earth-boring bit, comprising:

a substantially cylindrical first body comprising hard metal;

a substantially cylindrical first cutting element attached to an end of the first body, the first cutting element comprising a superhard material;

a trailing end defining the opposite end of the first body;

a substantially cylindrical second body comprising hard metal attached to the trailing end of the first body;

a cylindrical slot formed in the second body;

the cylindrical slot nonintersecting with the first cutting element;

a substantially cylindrical third body comprising hard metal located in the slot;

a substantially cylindrical second cutting element attached to an end of the third body, the second cutting element comprising a superhard material;

the first cutting element being substantially parallel to the second cutting element; and, the second cutting element being offset to a position behind the first cutting element.

* * * * *